US009474385B2

(12) United States Patent
Oh

(10) Patent No.: US 9,474,385 B2
(45) Date of Patent: Oct. 25, 2016

(54) FOLDABLE BED FRAME STRUCTURE

(71) Applicant: GRANTEC (XIAMEN) CO., LTD., Xiamen (CN)

(72) Inventor: Suk Kan Oh, Xiamen (CN)

(73) Assignee: GRANTEC (XIAMEN) CO., LTD., Xiamen, Fujian (CN)

( * ) Notice: Subject to any disclaimer, the term of this patent is extended or adjusted under 35 U.S.C. 154(b) by 0 days.

(21) Appl. No.: 14/664,938

(22) Filed: Mar. 23, 2015

(65) Prior Publication Data

US 2016/0206112 A1 Jul. 21, 2016

(30) Foreign Application Priority Data

Jan. 19, 2015 (CN) ..... 2015 2 0034549 U

(51) Int. Cl.

| | |
|---|---|
| ***A47C 19/00*** | (2006.01) |
| ***A47C 19/12*** | (2006.01) |
| *A47C 17/64* | (2006.01) |
| *A47C 19/14* | (2006.01) |
| *A47C 17/70* | (2006.01) |
| *A47C 17/74* | (2006.01) |

(52) U.S. Cl.

CPC ..... *A47C 19/126* (2013.01); *A47C 17/64* (2013.01); *A47C 17/70* (2013.01); *A47C 17/74* (2013.01); *A47C 19/12* (2013.01); *A47C 19/122* (2013.01); *A47C 19/124* (2013.01); *A47C 19/14* (2013.01)

(58) Field of Classification Search

CPC .... A47C 19/126; A47C 19/12; A47C 19/14; A47C 19/122; A47C 19/124; A47C 17/70; A47C 17/74; A47C 17/64; A47C 19/00; A47C 19/021

See application file for complete search history.

(56) References Cited

U.S. PATENT DOCUMENTS

| | | | | |
|---|---|---|---|---|
| 1,659,941 | A * | 2/1928 | Cable | A47C 19/122 5/117 |
| 2,772,424 | A * | 12/1956 | Roche | A47C 19/124 5/176.1 |
| 2,790,185 | A * | 4/1957 | Fox | A47C 19/021 5/174 |
| 8,312,576 | B1 * | 11/2012 | Oh | A47C 23/005 5/174 |
| 8,370,973 | B1 * | 2/2013 | Oh | A47C 19/122 5/174 |
| 8,832,876 | B1 * | 9/2014 | Oh | A47C 17/64 5/116 |
| 8,978,176 | B1 * | 3/2015 | Oh | A47C 19/005 5/200.1 |
| 2003/0011219 | A1 * | 1/2003 | Chun-Yueh | A47C 1/143 297/51 |
| 2003/0200608 | A1 * | 10/2003 | Polevoy | A47C 19/005 5/201 |

(Continued)

*Primary Examiner* — David E Sosnowski
*Assistant Examiner* — Morgan McClure
(74) *Attorney, Agent, or Firm* — Leong C. Lei

(57) ABSTRACT

A foldable bed frame structure includes two longitudinal supports, three transverse supports, and a plurality of legs. Each longitudinal support includes a first longitudinal pole and a second longitudinal pole which are symmetrically disposed and have connecting ends connected with each other. Each transverse support includes two transverse poles which are symmetrically disposed and have connecting ends pivotally connected through a U-shaped fixing plate. Free ends of the transverse poles are connected with the first longitudinal pole and the second longitudinal pole through connecting seats, respectively. The legs are pivotally connected to the transverse poles through the U-shaped fixing plate and the connecting seats, respectively. The foldable bed frame structure is convenient for transportation and use.

7 Claims, 5 Drawing Sheets

(56) References Cited

U.S. PATENT DOCUMENTS

2005/0278848 A1* 12/2005 Polevoy ..... A47C 19/005 5/201
2009/0249545 A1* 10/2009 Lee ..... A47C 19/122 5/111
2010/0235989 A1* 9/2010 Jin ..... A47C 19/126 5/174
2010/0299831 A1* 12/2010 Lee ..... A47C 19/126 5/202
2012/0246826 A1* 10/2012 Jin ..... A47C 19/04 5/400
2012/0304380 A1* 12/2012 Jin ..... A47C 19/126 5/400
2013/0025051 A1* 1/2013 Syrowitz ..... A47C 19/021 5/400

* cited by examiner

FOLDABLE BED FRAME STRUCTURE

BACKGROUND OF THE INVENTION (a) Technical Field of the Invention

The present invention relates to a bed, and more particularly to a foldable bed frame structure.

(b) Description of the Prior Art

A conventional wooden bed frame is composed of a frame and a bed board. The frame and the bed board are an integral one when the bed frame leaves the factory. The entire bed frame occupies large space for transportation, and it is very inconvenient for removal. Besides, when the user purchases the bed frame, he/she is unable to complete the removal and needs the aid of a porter. For a large bed frame, it is limited to the size of a corridor, an elevator or a door. This brings quite inconvenience to the porter. For a bed frame composed of a separate frame and a separate bed board, the longitudinal bed board also has the problem of inconvenient removal. When the frame is folded or unfolded, the parts of the frame must be disassembled or assembled one by one.

Accordingly, the inventor of the present invention has devoted himself based on his many years of practical experiences to solve these problems.

SUMMARY OF THE INVENTION

The primary object of the present invention is to provide a foldable bed frame structure which occupies less space for convenient transportation and use.

In order to achieve the aforesaid object, the foldable bed frame structure of the present invention comprises two longitudinal supports, three transverse supports connected at front and rear ends and middle portions of the two longitudinal supports, and a plurality of legs. Each longitudinal support comprises a first longitudinal pole and a second longitudinal pole. The first longitudinal pole and the second longitudinal pole are symmetrically disposed, and have connecting ends connected with each other and free ends opposite the connecting ends. The connecting ends of the first longitudinal pole and the second longitudinal pole are connected through a connecting plate. The connecting ends of the first longitudinal pole and the second longitudinal pole have notches, respectively. Each transverse support comprises two transverse poles which are symmetrically disposed and have connecting ends pivotally connected through a U-shaped fixing plate. Each transverse pole is a U-shaped pole with an opening facing downward. Free ends of the two transverse poles of each transverse support, opposite to the connecting ends of the two transverse poles, are connected with the free ends of the first longitudinal poles of the two longitudinal supports, the free ends of the second longitudinal poles of the two longitudinal supports, and the connecting ends of the first longitudinal pole and the second longitudinal pole of each longitudinal support through connecting seats, respectively. The legs are pivotally connected to the free end of each transverse pole and the bottom of the connecting ends of the two transverse poles through the U-shaped fixing plate and the connecting seats, respectively.

Preferably, the connecting ends of the first longitudinal pole and the second longitudinal pole are provided with a pivot member. The pivot member is an h-like configuration and comprises a long side and a short side connected with a lower end of the long side through a curved portion thereof. An upper end of the long side has a pivot hole. The connecting ends of the first longitudinal pole and the second longitudinal pole each have a first connecting hole corresponding to the pivot hole and a recess adapted to accommodate the short side of the pivot member.

Preferably, each U-shaped transverse pole has pivotal holes disposed at two ends thereof and communicating with two side walls thereof. The U-shaped fixing plate has an opening facing downward and two connecting holes at two side walls thereof corresponding to the pivotal holes at the connecting ends of the two transverse poles. The two transverse poles are pivotally connected by a pin inserted through the pivotal holes and the connecting holes. The bottom of the U-shaped fixing plate directly leans against the U-shaped bottom ends of the two transverse poles.

Preferably, each connecting seat comprises a U-shaped connecting plate and two tabs extending outward from two side walls of the U-shaped connecting plate. The two side walls of the U-shaped connecting plate and the two tabs have shaft holes. The U-shaped connecting plate has an opening facing the transverse poles. The connecting seat and the transverse poles are fixed by a pin inserted through the shaft holes of the U-shaped connecting plate and the pivotal holes at the free ends of the U-shaped transverse poles. The tabs face downward. Each leg is fixed to the fixing plate by a bolt cooperating with a nut to connect the shaft holes of the tabs.

Preferably, the first longitudinal pole and the second longitudinal pole are L-shaped poles each having a bottom and an upright side.

Preferably, the upright side at the free end of the first longitudinal pole or the second longitudinal pole is movably connected with an L-shaped headboard stopper. One end of the headboard stopper is connected to the upright side of the first longitudinal pole or the second longitudinal pole. Another end of the headboard is adapted to retain the bottom of the first longitudinal pole or the second longitudinal pole.

According to the foldable bed frame structure of the present invention, the longitudinal supports and the transverse supports at two ends of the longitudinal supports are pivotally connected with each other. The middle portions of the longitudinal supports are connected with the middle transverse support. Each support is composed of two poles which are pivotally connected through a pivot member. When folded, the poles are folded and the legs are folded in the U-shaped transverse supports, so that the poles of the bed frame are folded together for convenient storage, transportation and use.

DETAILED DESCRIPTION OF THE PREFERRED EMBODIMENTS

Embodiments of the present invention will now be described, by way of example only, with reference to the accompanying drawings.

Figure 1:
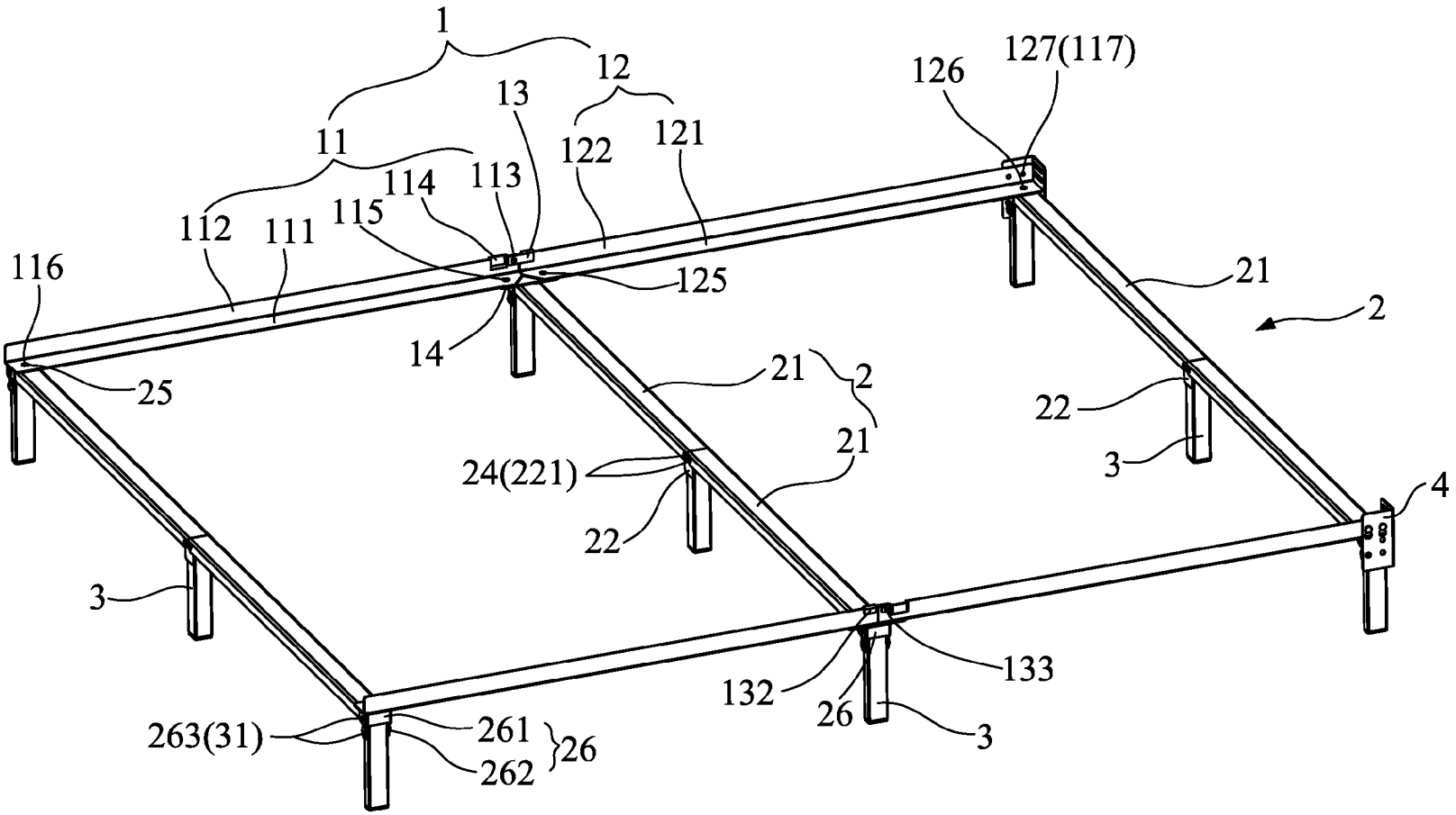
FIG. 1 is a perspective view of the present invention in an unfolded state.
Figure 2:
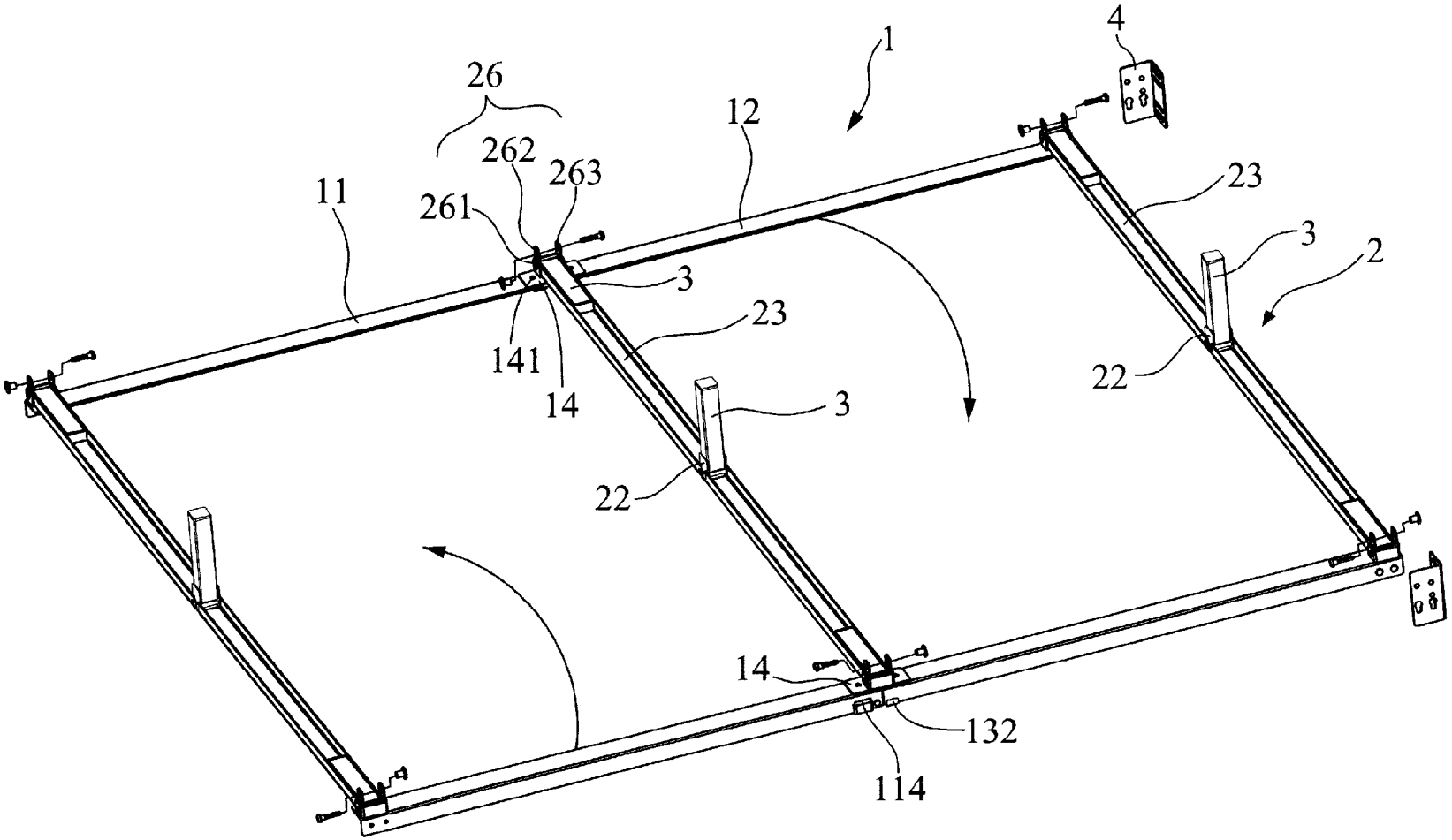
FIG. 2 is a first schematic view of the present invention when folded.

As shown in FIG. 1 and FIG. 2, the present invention discloses a foldable bed frame structure. The foldable bed frame structure comprises two longitudinal supports 1, three transverse supports 2 connected at front and rear ends and middle portions of the two longitudinal supports 1, and a plurality of legs 3. It is noted that the supports of the foldable bed frame structure of the present invention are made of wood and pivot members and connecting members are made of a metallic material, which is beneficial for production and operation of the bed frame.

Each longitudinal support 1 comprises a first longitudinal pole 11 having a bottom 111 and an upright side 112 and a second longitudinal pole 12 having a bottom 121 and an upright side 122. The first longitudinal pole 11 and the second longitudinal pole 12 are symmetrically disposed, and have connecting ends connected with each other and free ends opposite the connecting ends. The connecting ends of the first longitudinal pole 11 and the second longitudinal pole 12 have notches and are connected through a pivot member 13 and a connecting plate 14. The pivot member 13 is an h-like configuration, and comprises a long side 131 and a short side 132 connected with a lower end of the long side 131 through a curved portion thereof. An upper end of the long side 131 has a pivot hole 133. The upright sides 112, 122 at the connecting ends of the first longitudinal pole 11 and the second longitudinal pole 12 each have a first connecting hole 113 and a recess 114 corresponding to the pivot hole 133. The recess 114 is adapted to accommodate the short side 132 of the pivot member 13. The bottoms 111, 121 at the connecting ends of the first longitudinal pole 11 and the second longitudinal pole 12 have second connecting holes 115, 125. The connecting plate 14 has installation holes 141 corresponding to the second connecting holes 115, 125. The bottoms 111, 121 at the free ends of the first longitudinal pole 11 and the second longitudinal pole 12 have third connecting holes 116, 126. The upright side 112 or 122 at the free end of the first longitudinal pole 11 or the second longitudinal pole 12 has a fourth connecting hole 117 or 127 for connecting a headboard stopper 4. The headboard stopper 4 has an L shape with one side connected to the upright side 112 or 122 of the first longitudinal pole 11 or the second longitudinal pole 12 and another side adapted to retain the bottom 111 or 121.

Each transverse support 2 comprises two transverse poles 21 which are symmetrically disposed and have connecting ends pivotally connected through a U-shaped fixing plate 22. Each transverse pole 21 is a U-shaped pole. Each transverse pole 21 has an opening 23 facing downward and pivotal holes 24 disposed at two ends thereof and communicating with two side walls thereof. The U-shaped bottom of each transverse pole 21 has a fixing hole 25 at a free end thereof. The U-shaped fixing plate 22 has an opening facing downward and two connecting holes 221 at two side walls thereof corresponding to the pivotal holes 24 at the connecting ends of the two transverse poles 21. The bottom of the U-shaped fixing plate 22 directly leans against the U-shaped bottom ends of the two transverse poles. The free ends of the two transverse poles 21, opposite to the connecting ends, are respectively connected with the longitudinal supports 1 and the legs 3 through connecting seats 26. Each connecting seat 26 comprises a U-shaped connecting plate 261 and two tabs 262 extending outward from two side walls of the U-shaped connecting plate 261. The two side walls of the U-shaped connecting plate 261 and the two tabs 262 have shaft holes 263.

The legs 3 are disposed in the openings 23 of the U-shaped transverse poles 21 respectively and connected by the connecting seats 26. Each leg 3 has opposing ends at a top thereof and coupling holes 31 corresponding to the two shaft hole 263 of the connecting seat 26. The bottom of each leg 3 can be provided with a leg sleeve.

When the present invention is installed, the L-shaped first longitudinal pole 11 and the L-shaped second longitudinal pole 12 are placed symmetrically. Through rivets, the pivot hole 133 of the pivot member 13 is pivotally connected with the first connecting hole 113 of the first longitudinal pole 11. The curved trough formed by the long side 131 and the short side 132 of the pivot member 13 is fitted on the second longitudinal pole 12 from the top of the upright side 122 of the second longitudinal pole 12. The installation holes 141 of the connecting plate 14 correspond to the second connecting holes 115, 125 of the first longitudinal pole 11 and the second longitudinal pole 12. The connecting plate 14 is fixed on the longitudinal support 1 through a pin. The headboard stopper 4 is locked to the fourth connecting hole 117 or 127. The openings of the two U-shaped transverse poles 21 approach each other. The top of the U-shaped fixing plate 22 with the leg 3 holds against the joint of the two transverse poles 21. A rivet is inserted through the pivotal holes 24 and the connecting holes 221 to fix the U-shaped fixing plate 22 with the leg 3 to the transverse poles 21. The free ends of the two transverse poles 21 located at the two ends of the longitudinal supports 1 are locked to the free ends of the first longitudinal pole 11 and the second longitudinal pole 12. The free ends of the two transverse poles 21 located at the middle portions of the longitudinal supports 1 are locked on the connecting plates 14 connected to the first longitudinal pole 11 and the second longitudinal pole 12. A hexagonal bolt cooperates with a T-shaped nut to connect the shaft holes 263 of the tabs 262 of the connecting seat 26 and one coupling hole 31 of the leg 3. The connecting seat 26 with the leg 3 is disposed at the free end of each transverse pole 21. The opening of the U-shaped connecting plate 261 of the connecting seat 26 faces the other end of the transverse pole 21. The two tabs 262 are disposed downward. The shaft holes 263 of the side walls of the U-shaped connecting plate 261, the other coupling hole 31 of the leg 3, and pivotal holes 24 of the transverse poles 21 are pivotally connected with rivets. FIG. 1 show an unfolded state after installed.

Figure 3:
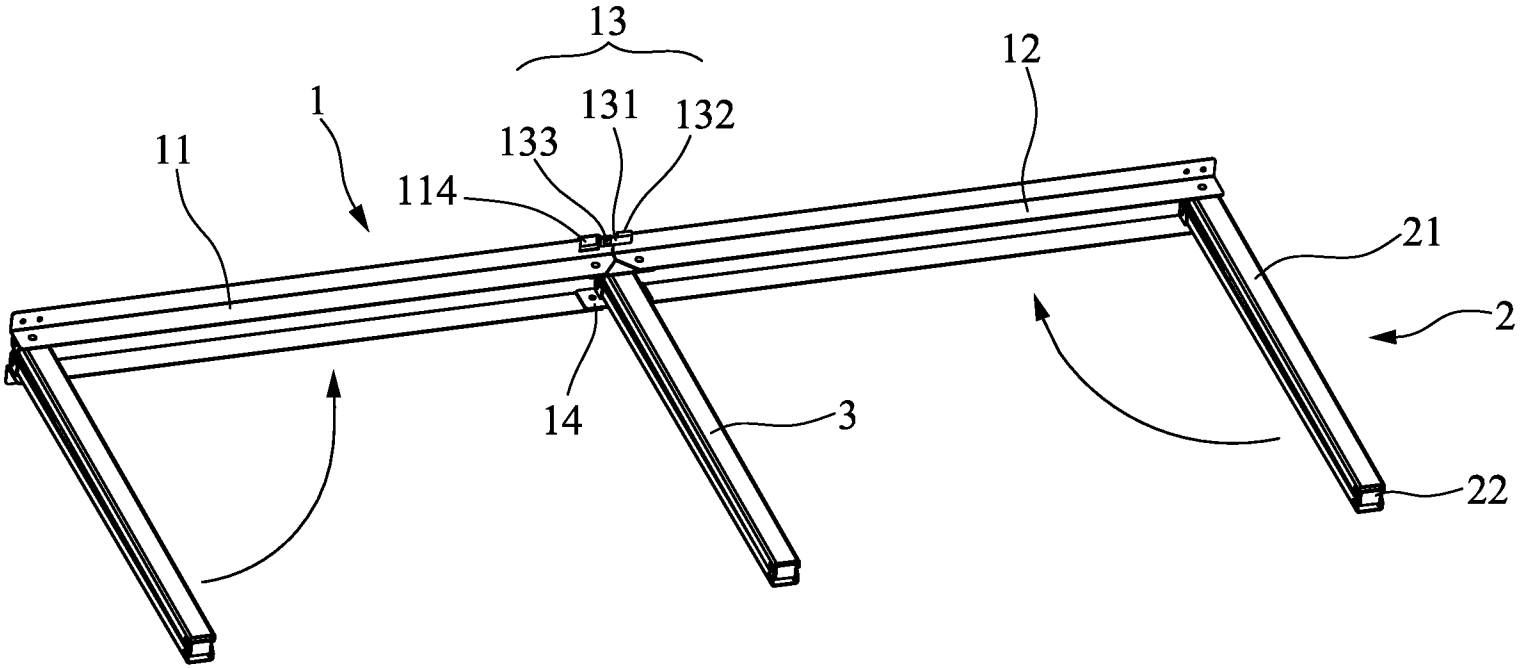
FIG. 3 is a second schematic view of the present invention when folded.
Figure 4:
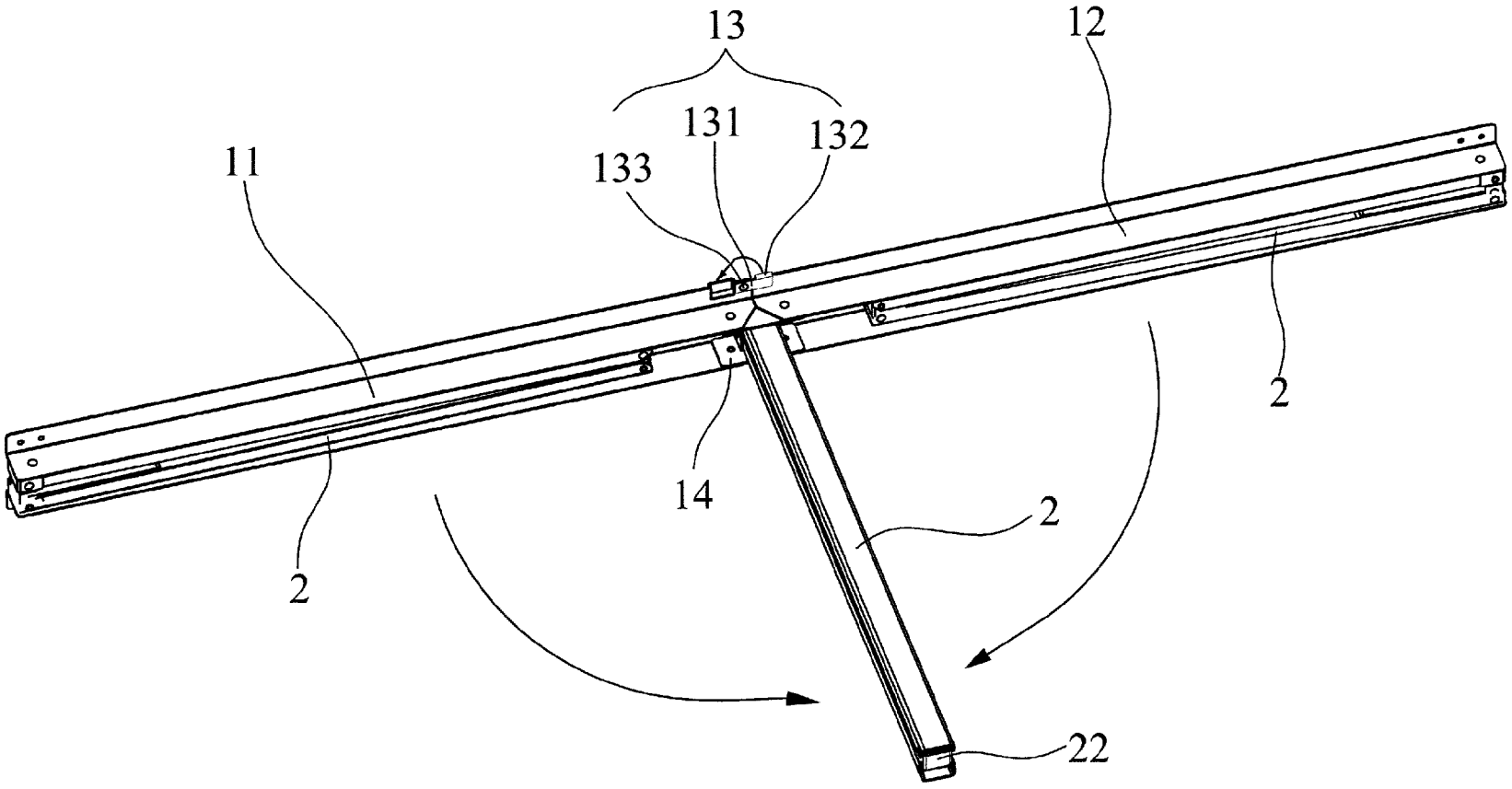
FIG. 4 is a third schematic view of the present invention when folded.
Figure 5:
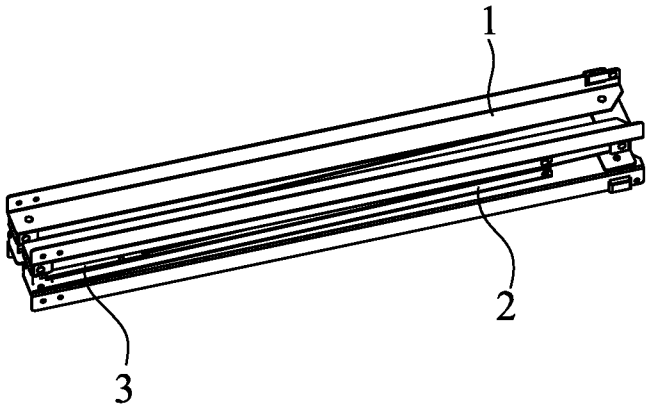
FIG. 5 is a perspective view of the present invention in a folded state.

As shown in FIG. 2 to FIG. 5, when the present invention is folded, the headboard stopper 4 is disassembled and the hexagonal bolt and the T-shaped nut to fix the connecting seat 26 and the leg 3 at the free end of each transverse pole 21 are disassembled, so that the leg 3 can be turned toward the connecting end of the transverse pole 21 until all the legs 3 are folded in the openings 23 of the transverse poles 21, respectively. As shown in FIG. 2, with the middle leg 3 fixed at the connecting ends of the two transverse poles 21 as a pivot, the longitudinal supports 1 and the transverse poles 21 fixed at the two sides of the middle legs 3 are folded toward the middle legs 3 until the two U-shaped openings of the two transverse poles 21 leans against each other to wrap the middle leg 3 therein to form an E shape as shown in FIG. 3. After that, the legs 3 at the two sides are folded toward the longitudinal supports 1 to form a T shape as shown in FIG. 4. Finally, the connecting plates 14 pivotally connected with the first longitudinal pole 11 is turned 180 degrees to disengage from the second longitudinal pole 12. The short side 142 of the connecting plate 14 is accommodated in the recess 114 of the first longitudinal pole 11. The first longitudinal poles 11 and the second longitudinal poles 12 with the folded transverse supports 2 and the legs 3 are folded toward the middle legs 3, as shown in FIG. 5. In this way to fold the bed frame, the poles of the bed frame can be folded together to reduce the size of the bed frame for convenient transportation and use. When the user wants to unfold the bed frame, the operation is done reversely, without the need to connect the poles one by one.

Although particular embodiments of the present invention have been described in detail for purposes of illustration, various modifications and enhancements may be made without departing from the spirit and scope of the present invention. Accordingly, the present invention is not to be limited except as by the appended claims.

I claim:

1. A foldable bed frame structure, comprising two longitudinal supports, three transverse supports connected at front and rear ends and middle portions of the two longitudinal supports, and a plurality of legs;

characterized by: each longitudinal support comprising a first longitudinal pole and a second longitudinal pole, the first longitudinal pole and the second longitudinal pole being symmetrically disposed and having connecting ends connected with each other and free ends opposite the connecting ends, the connecting ends of the first longitudinal pole and the second longitudinal pole being connected through a connecting plate, the connecting ends of the first longitudinal pole and the second longitudinal pole having notches respectively; each transverse support comprising two transverse poles which are symmetrically disposed and have connecting ends pivotally connected through a U-shaped fixing plate, each transverse pole being a U-shaped pole with an opening facing downward, free ends of the two transverse poles of each transverse support, opposite to the connecting ends of the two transverse poles, being connected with the free ends of the first longitudinal poles of the two longitudinal supports, the free ends of the second longitudinal poles of the two longitudinal supports, and the connecting ends of the first longitudinal pole and the second longitudinal pole of each longitudinal support through connecting seats respectively; the legs being pivotally connected to the free end of each transverse pole and the bottom of the connecting ends of the two transverse poles through the U-shaped fixing plate and the connecting seats, respectively, wherein the connecting ends of the first longitudinal pole and the second longitudinal pole are provided with a pivot member, the pivot member being an h-like configuration and comprising a long side and a short side connected with a lower end of the long side through a curved portion thereof, an upper end of the long side having a pivot hole, the connecting ends of the first longitudinal pole and the second longitudinal pole each having a first connecting hole corresponding to the pivot hole and a recess adapted to accommodate the short side of the pivot member.

2. The foldable bed frame structure as claimed in claim 1, wherein the first longitudinal pole and the second longitudinal pole are L-shaped poles each having a bottom and an upright side.

3. The foldable bed frame structure as claimed in claim 2, wherein the upright side at the free end of the first longitudinal pole or the second longitudinal pole is movably connected with an L-shaped headboard stopper, one end of the headboard stopper being connected to the upright side of the first longitudinal pole or the second longitudinal pole, another end of the headboard being adapted to retain the bottom of the first longitudinal pole or the second longitudinal pole.

4. The foldable bed frame structure as claimed in claim 1, wherein each U-shaped transverse pole has pivotal holes disposed at two ends thereof and communicating with two side walls thereof, the U-shaped fixing plate having an opening facing downward and two connecting holes at two side walls thereof corresponding to the pivotal holes at the connecting ends of the two transverse poles, the two transverse poles being pivotally connected by a pin inserted through the pivotal holes and the connecting holes, the bottom of the U-shaped fixing plate directly leaning against the U-shaped bottom ends of the two transverse poles.

5. The foldable bed frame structure as claimed in claim 1, wherein each connecting seat comprises a U-shaped connecting plate and two tabs extending outward from two side walls of the U-shaped connecting plate, the two side walls of the U-shaped connecting plate and the two tabs having shaft holes, the U-shaped connecting plate having an opening facing the transverse poles, the connecting seat and the transverse poles being fixed by a pin inserted through the shaft holes of the U-shaped connecting plate and the pivotal holes at the free ends of the U-shaped transverse poles, the tabs facing downward, each leg being fixed to the fixing plate by a bolt cooperating with a nut to connect the shaft holes of the tabs.

6. The foldable bed frame structure as claimed in claim 1, wherein the first longitudinal pole and the second longitudinal pole are L-shaped poles each having a bottom and an upright side.

7. The foldable bed frame structure as claimed in claim 6, wherein the upright side at the free end of the first longitudinal pole or the second longitudinal pole is movably connected with an L-shaped headboard stopper, one end of the headboard stopper being connected to the upright side of the first longitudinal pole or the second longitudinal pole, another end of the headboard being adapted to retain the bottom of the first longitudinal pole or the second longitudinal pole.

* * * * *